US009109866B2

(12) United States Patent
Newman

(10) Patent No.: US 9,109,866 B2
(45) Date of Patent: Aug. 18, 2015

(54) BRASS MARKER

(71) Applicant: Manuel Newman, Vallejo, CA (US)

(72) Inventor: Manuel Newman, Vallejo, CA (US)

( * ) Notice: Subject to any disclaimer, the term of this patent is extended or adjusted under 35 U.S.C. 154(b) by 285 days.

(21) Appl. No.: 13/914,102

(22) Filed: Jun. 10, 2013

(65) Prior Publication Data

US 2013/0333547 A1 Dec. 19, 2013

Related U.S. Application Data

(60) Provisional application No. 61/659,109, filed on Jun. 13, 2012.

(51) Int. Cl.
*F42B 33/10* (2006.01)
*F42B 33/14* (2006.01)

(52) U.S. Cl.
CPC ..... *F42B 33/10* (2013.01); *F42B 33/14* (2013.01)

(58) Field of Classification Search
CPC ..... F42B 33/00; F42B 33/10; F42B 33/14
USPC ..... 86/19.5, 19.7, 1.1; 102/430, 464
See application file for complete search history.

(56) References Cited

U.S. PATENT DOCUMENTS 5,301,436 A * 4/1994 Johnston ..... 33/506
5,685,100 A 11/1997 Atchison
6,293,204 B1 9/2001 Regen
7,047,877 B2 * 5/2006 Powney et al. ..... 101/35
7,240,619 B2 7/2007 Kinoshita
7,823,495 B2 * 11/2010 Filho ..... 86/1.1
2004/0220883 A1 11/2004 West
2005/0005806 A1 1/2005 Mace et al.
2005/0045056 A1 * 3/2005 EkenediliChukwu ..... 102/430
2006/0174531 A1 8/2006 Lizotte et al.

* cited by examiner

*Primary Examiner* — James S Bergin

(74) *Attorney, Agent, or Firm* — Buckingham, Doolittle & Burroughs, LLC

(57) ABSTRACT

A brass ammunition marking device is disclosed that allows users to mark their ammunition casings, so that users may easily identify and collect their casings at a shooting range for reuse. The brass ammunition marking device comprises a chuck for retaining a cartridge, a motor, a cylindrical component, and two marking device. The marking device is inserted into at least one of the opposed open ends of the cylindrical component with the marking tip side inserted first, such that the marking tip contacts the exterior surface of the ammunition cartridge and creates a mark. Further, the chuck retains the cartridge, and the motor is in electrical communication with the chuck for rotating the cartridge about an axis. The motor further comprises a drive shaft that contacts the chuck and rotates the cartridge, while the cylindrical component is held stationary. Additionally, the motor is typically powered by a battery.

20 Claims, 3 Drawing Sheets

BRASS MARKER

CROSS-REFERENCE

This application claims priority from Provisional Patent Application Ser. No. 61/659,109 filed Jun. 13, 2012.

BACKGROUND

When at a shooting range, any person who reloads can find it highly difficult to identify spent brass casings which comes from their own firearm when among others who are shooting the same caliber. Without some sort of marking on the brass casings, users have to pick up each piece of brass to check for a specific marking. This can be time consuming and will lead to not finding all of their ammunition casings. Some users mark the brass casings themselves with a mark across the bottom, but this can be tedious and time-consuming. Other users may simply purchase new ammunition each time they go to the shooting range, but this can be very expensive. An effective solution is necessary.

The present invention provides users with a convenient and quick way to identify and collect their ammunition brass casings after discharging a firearm, for example, at a shooting range. This brass marking device allows users to make a mark around the circumference of their brass casings, allowing users to easily identify their brass casings from other user's brass lying on the ground. By using this device, users may will quickly and easily collect their spent casings, thereby eliminating the need to purchase new brass casing which can be expensive. Anyone who reloads and regularly goes to a shooting range to practice their shooting skills may appreciate the benefits afforded by this device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a brass ammunition marking device that allows users to mark their brass ammunition casings. This will allow users to easily identify and collect their casings after use the ammunition. The marking device comprises of two thumb screws for retaining markers in the chuck unit which will mark the brass, a motor, a cylindrical component, two marking devices. The marking device is inserted into at one of the opposed open ends of the cylindrical component with the marking tip side inserted first, such that the marking tip contacts the exterior surface of the brass ammunition cartridge. Tightened with the thumb screw this keeps the marker in place and creates a mark. Further, the thumbscrew retains the marker cartridge, and the motor is in electrical communication with the chuck for rotating the cartridge about an axis. The motor further comprises a drive shaft that contacts the chuck and rotates the cartridge about an axis, while the cylindrical component (and the marking devices) are held stationary. Additionally, the motor is typically powered by a 9 volt battery.

A marking device is inserted into each of the opposed open ends of the cylindrical component to create offset lines on the exterior surface of the brass ammunition cartridge. Furthermore the cylindrical component can accept cartridges of different diameter from pistol cartridges such as 9 mm, .40 caliber, and .45 caliber, and even some rifle sized brass up to 0.470 mm. It is also contemplated, that the motor could be in electrical communication with the cylindrical component, such that the cylindrical component (and the marking devices) can rotate, while the cartridge is held stationary.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
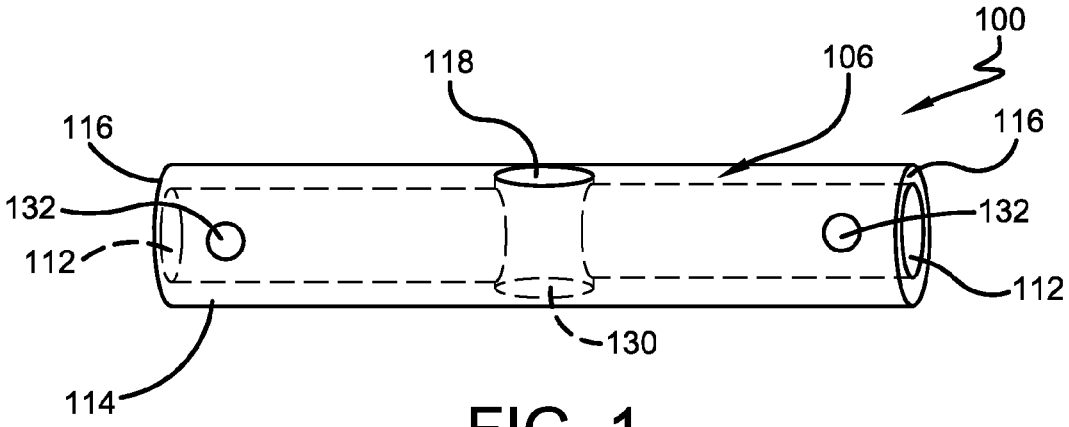
FIG. 1 illustrates a transparent perspective view of the cylindrical component of the brass ammunition marking device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a brass ammunition marking device that provides users with a convenient and quick way to mark and identify to collect their brass casings after shooting at a range. The brass ammunition marking device allows users to make two colored marks around the circumference of their brass or casings, which then allows users to easily identify their spent brass casings from other users spent brass casings lying on the ground. By using this device, users will quickly gather their spent cartridges for reusing, as opposed to having to continuously purchase new ammunition which can be expensive. Anyone who regularly goes to a shooting range to practice their shooting skills may appreciate the benefits afforded by this device.

The disclosed brass ammunition marking device comprises a chuck for retaining a cartridge, a motor for rotating the chuck, a cylindrical component for retaining two marking devices. The marking device is inserted into at least one of the opposed open ends of the cylindrical component with the marking tip side inserted first, such that the marking tip contacts the exterior surface of the ammunition cartridge and is capable of creating a mark thereon. Further, the adjustable chuck retains the cartridge, and the motor is in electrical communication with the chuck for rotating the cartridge about a substantially vertical axis. The motor further comprises a drive shaft that contacts the chuck and rotates the cartridge, while the cylindrical component and the marker(s) positioned therein are held stationary. Additionally, the motor is typically powered by a battery.

Figure 2:
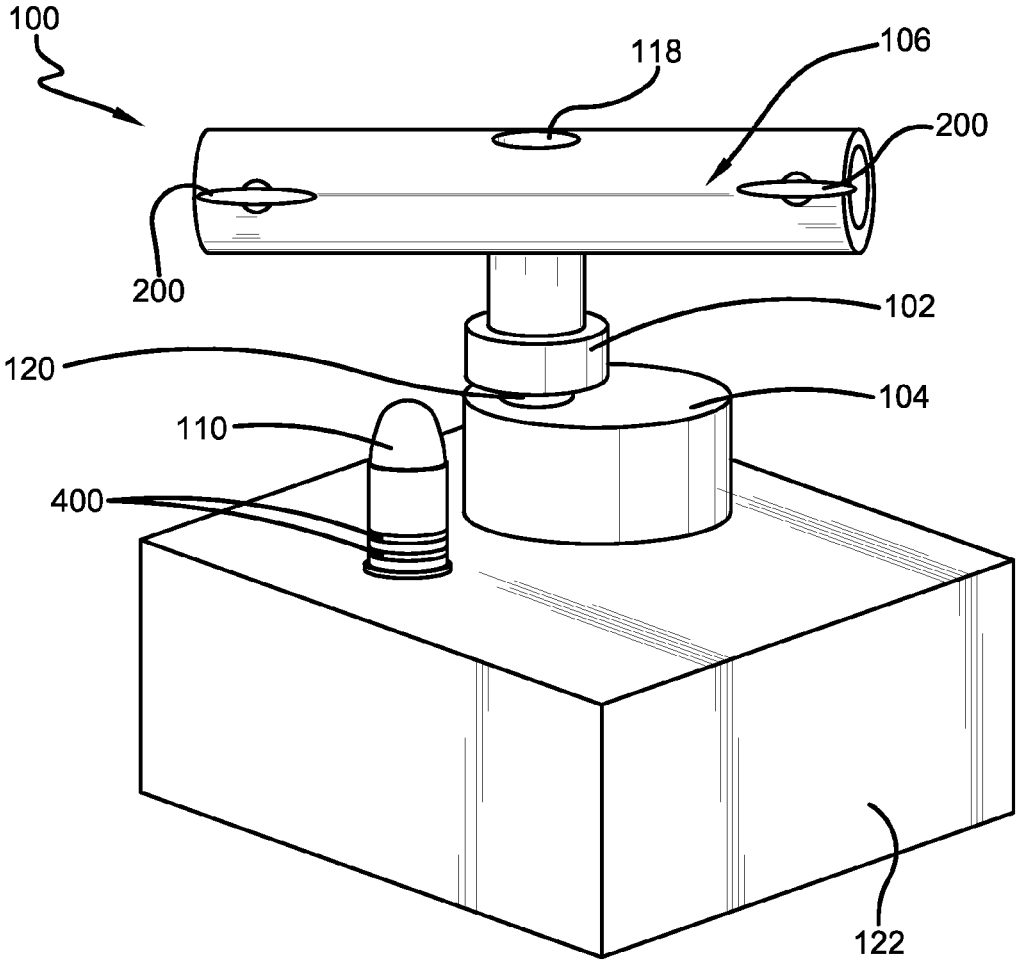
FIG. 2 illustrates a perspective view of the brass ammunition marking device in accordance with the disclosed architecture.
Figure 3:
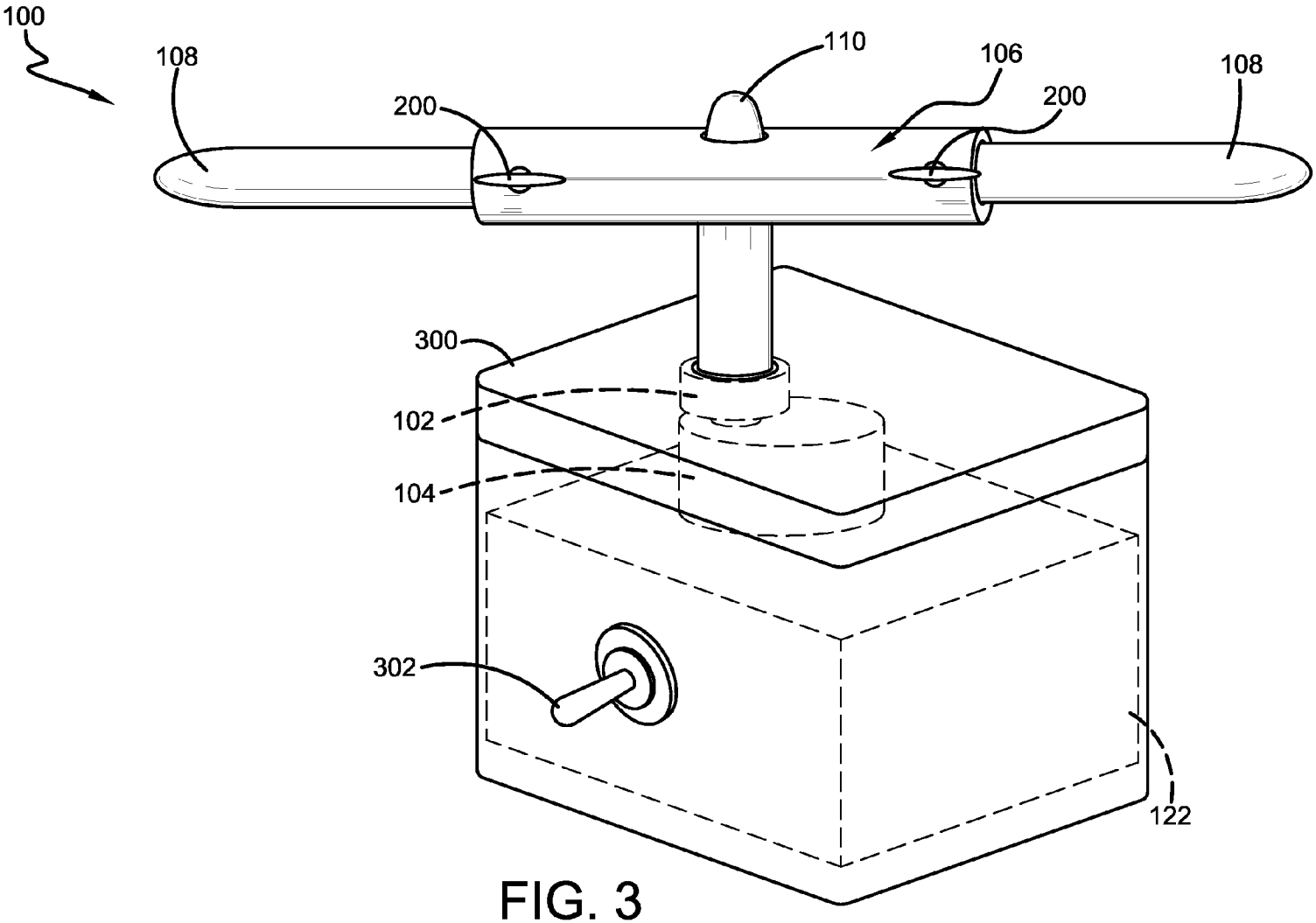
FIG. 3 illustrates a perspective view of the brass ammunition marking device with the marking devices inserted in the cylindrical component in accordance with the disclosed architecture.

Referring initially to the drawings, FIGS. 1-3 illustrate the brass ammunition marking device 100 that allows users to mark their ammunition casings, so that users may easily identify and collect their spent casings at a shooting range for reuse. The brass ammunition marking device 100 comprises an adjustable chuck 102 for retaining a cartridge 110, a motor 104, a cylindrical component 106, and at least one marking device 108 (as shown in FIG. 3).

The cylindrical component 106 comprises an interior surface 112, an exterior surface 114, opposed open ends 116, and at least one opening (or through-hole) 118 for receiving the cartridge 110. Typically, the component 106 is cylindrical in shape, however any other suitable shape can be used as is known in the art without affecting the overall concept of the invention. The cylindrical component 106 would generally be constructed of plastic, aluminum, stainless steel, etc., though any other suitable material may be used to manufacture the cylindrical component 106 as is known in the art without affecting the overall concept of the invention.

The cylindrical component 106 can also comprise a variety of colors and designs to suit user and manufacturing preference. The cylindrical component 106 is approximately 5 inches long, as measured between the opposed open ends 116, and approximately 1 inch in diameter, to accommodate most marking devices.

Typically, the cylindrical component 106 is hollow, but it does not have to be and can function by being partly solid, as long as a marking device 108 inserted into one of the opposed open ends 116 can contact an exterior surface of an ammunition casing (or cartridge) 110 inserted into the opening (or through-hole) 118 of the cylindrical component 106 (as shown in FIG. 1). Furthermore, the cylindrical component 106 can comprise a plurality of openings (or through-holes) 118, wherein each opening 118 is comprised of a different diameter for receiving a cartridge (or casing) 110 of that specific diameter. Thus, the cylindrical component 106 can accept cartridges 118 of different diameter (i.e., cartridges of different calibers).

The brass ammunition marking device 100 further comprises two marking device 108 that is inserted into at least one of the opposed open ends 116 of the cylindrical component 106. The marking device 108 can be any suitable marking device as is known in the art, such as a permenate marker, a paint pen, etc., and can be any suitable color as is known in the art. Further, multiple marking devices 108 can be used with the cylindrical component 106 and each of these marking devices 108 can be a different color. The marking device 108 is inserted into the opposed open ends 116 with the marking tip side inserted first, such that the marking tip contacts the exterior surface of the ammunition cartridge 110 and creates a mark. In a preferred embodiment, a marking device 108 is inserted into both of the opposed open ends 116 of the cylindrical component 106, to create multiple marks on the exterior surface of the ammunition cartridge 110. However, the device 100 can function with only one marking device 108 inserted into one of the opposed open ends 116 of the cylindrical component 106 as well. Further, the marking devices 108 are secured in the cylindrical component 106 and can be adjusted to varying heights via a thumbscrew 200 (as shown in FIG. 2) inserted into the thumb screw holes 132, or any other suitable securing mechanism as is known in the art without affecting the overall concept of the invention.

The brass ammunition marking device 100 further comprises an adjustable chuck 102 for retaining a cartridge 110, that is inserted into the shaft hole 130. The chuck (or collet) 102 can be any suitable clamp or securing mechanism as is known in the art for holding or securing an object. Specifically, a cartridge 110 is inserted into the chuck 102 and protrudes upwardly therefrom like a drill bit in a drill chuck, and is retained by the chuck 102. The chuck 102 is adjustable and thus capable of holding (or securing) different diameters of casings or cartridges 110 (i.e., cartridges of different calibers) depending on the needs and wants of a user.

Furthermore, the brass ammunition marking device 100 provides a motor 104 in electrical communication with the chuck 102 for rotating the cartridge 110 about an axis. Thus, the chuck 102 is driven by the motor 104 and is capable of rotating the cartridge 110 about an axis. The motor 104 is typically a DC gear head motor, but can be any suitable motor as is known in the art. The motor 104 further comprises a drive shaft 120 that contacts (or engages) the chuck 102 and rotates the same along with the cartridge 110 positioned therein. Any suitable drive shaft 120 as is known in the art can be used, as long as the drive shaft 120 is compatible with (able to communicate with) the motor 104 and the chuck 102 to rotate the cartridge 110 about an axis, while the cylindrical component 106 (and the marking devices 108) are held stationary. It is also contemplated, that the motor 104 could be in electrical communication with the cylindrical component 106, such that the cylindrical component 106 (and the marking devices 108) can rotate about the cartridge, while the brass cartridge is held stationary, thereby marking the cartridge.

Additionally, the motor 104 is in electrical communication with a battery 122. The battery 122 acts to power the motor 104 which rotates the cartridge 110. Typically, the battery 122 is a 9 volt battery, but any other suitable battery or other power source can be used as is known in the art, such as an electrical cord, etc.

In operation, the cartridge 110 is inserted into the chuck 102 and secured, and then the cylindrical component 106 is inserted over the cartridge 110 via inserting the cartridge 110 into the through-hole 118. A marking device 108 is then inserted into one or both of the opposed open ends 116 of the cylindrical component 106 to contact an exterior surface of the cartridge 110. Then, the chuck 102, which is driven by the motor 104, rotates the cartridge 110 about an axis. The rotating of the cartridge 110 by the motor 104 and the contact of the marking device 108 creates a mark 400 around the circumference of the cartridge 110, which labels the cartridge 110 and allows for easy identification by the user.

Furthermore, the motor 104 and battery 122 can be encased in a housing 300 (as shown in FIG. 3), and can include a power switch 302 for turning on and off the ammunition marking device 100. The housing 300 can be manufactured of any suitable material, such as plastic, aluminum, stainless steel, etc.

Figure 4:
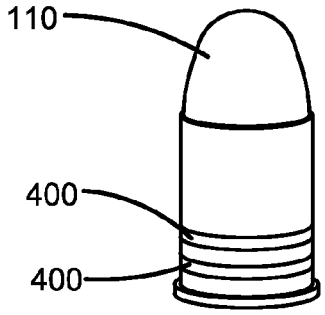
FIG. 4 illustrates a perspective view of a cartridge marked by the brass ammunition marking device in accordance with the disclosed architecture.

FIG. 4 illustrates a cartridge 110 marked by the brass ammunition marking device 100. As stated supra, the ammunition marking device 100 comprises a chuck 102 for retaining a cartridge 110, a motor 104, a cylindrical component 106, and at least one marking device 108. The marking device 108 is inserted into at least one of the opposed open ends 116 of the cylindrical component 106 with the marking tip side inserted first, such that the marking tip contacts the exterior surface of the ammunition cartridge 110 and creates a mark 400.

Furthermore, multiple marking devices 108 can be used with the cylindrical component 106 and each of these marking devices 108 can be a different color (as shown in FIG. 4). The marking devices 108 are inserted into both of the opposed open ends 116 with the marking tip side inserted first, such that the marking tip contacts the exterior surface of the ammunition cartridge 110 and each of the marking devices 108 creates a separate mark 400, depending on the insertion of the marking devices 108 and the adjustment of the thumb screws.

Figure 5:
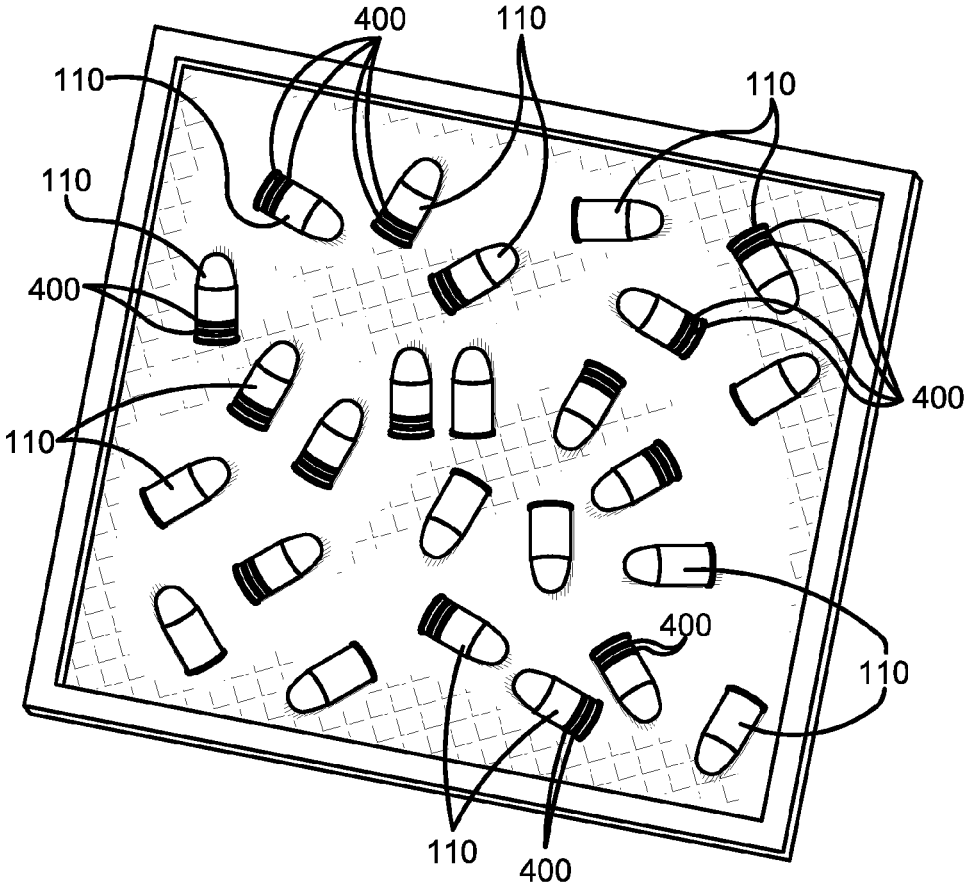
FIG. 5 illustrates a top perspective view of a plurality of cartridges marked by the brass ammunition marking device in accordance with the disclosed architecture.

FIG. 5 illustrates a plurality of cartridges 110 marked by the brass ammunition marking device 100. In operation, a user (not shown) would choose the color and/or the amount of marking devices 108 that meet their needs and/or wants. The user would then determine what type of caliber casing (or cartridge) 110 to mark. The user then slides the marking device 108 or the marking devices 108 into the opposed open ends 116 of the cylindrical component 106. Specifically, the user inserts the marking devices 108 into the opposed open ends 116 with the marking tip side inserted first, such that the marking tip contacts the exterior surface of the ammunition cartridge 110 and creates a mark 400. The user then secures the marking devices 108 into the cylindrical component 106 via tightening a thumbscrew.

The user would then insert the specific cartridge 110 into the chuck 102 and secure it. The user then inserts the cylindrical component 106 over the cartridge 110 via inserting the cartridge 110 into the through-hole 118 of the cylindrical component 106, such that the marking devices 108 contact an exterior surface of the cartridge 110. Then, the user would position the chuck 102 in electrical communication with the motor 104 to rotate the cartridge 110. The chuck 102, which is driven by the motor 104, rotates the cartridge 110 about an axis. The rotating of the cartridge 110 by the motor 104 and the contact of the marking devices 108 create a mark 400 or marks 400 around the circumference of the cartridge 110, which labels the cartridge 110 and allows for easy identification.

Once the cartridges 110 are labeled, the user can reload and reuse the cartridges 110 at a shooting range or other shooting area. Then, after the user has expelled all of the cartridges 110 from their firearm, the user can easily identify their marked cartridges from the rest of the unmarked cartridges, which allows the user to easily identify and collect their casings (or cartridges) 110 at the shooting range for reuse.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An ammunition marking device comprising:

a chuck for retaining a cartridge;

a motor in electrical communication with the chuck for rotating the cartridge about an axis;

a cylindrical component comprising an interior surface, an exterior surface, opposed open ends, and at least one opening for receiving the cartridge;

at least one marking device inserted into one of the opposed open ends such that the marking device contacts an exterior surface of the cartridge; and wherein the rotating of the cartridge by the motor and the contact of the marking device creates a mark around the circumference of the cartridge.

2. The device of claim 1, wherein the motor is in electrical communication with a battery.

3. The device of claim 2, wherein the motor is a DC gear head motor.

4. The device of claim 3, wherein the battery is a 9 volt battery.

5. The device of claim 4, wherein the motor comprises a drive shaft that contacts the chuck and rotates the cartridge.

6. The device of claim 1, wherein there is a marking device inserted into both opposed open ends.

7. The device of claim 6, wherein the marking devices are different colors.

8. The device of claim 6, wherein the marking devices are secured in the cylindrical component via a thumbscrew.

9. The device of claim 1, wherein there is a plurality of openings comprising different diameters for receiving cartridges of different diameters.

10. An ammunition marking device comprising:

a chuck for retaining a cartridge;

a drive shaft that contacts the chuck and rotates the cartridge;

a motor in electrical communication with the drive shaft for rotating the cartridge about an axis;

a cylindrical component comprising an interior surface, an exterior surface, opposed open ends, and at least one opening for receiving the cartridge;

a marking device inserted into both of the opposed open ends such that each of the marking devices contact an exterior surface of the cartridge; and wherein the rotating of the cartridge by the motor and the contact of the marking devices create a mark around the circumference of the cartridge.

11. The device of claim 10, wherein the marking devices are different colors.

12. The device of claim 10, wherein the marking devices are secured in the cylindrical component via a thumbscrew.

13. The device of claim 10, wherein there is a plurality of openings comprising different diameters for receiving cartridges of different diameters.

14. The device of claim 10, wherein the motor is in electrical communication with a battery.

15. The device of claim 14, wherein the motor is a DC gear head motor.

16. The device of claim 15, wherein the battery is a 9 volt battery.

17. An ammunition marking device comprising:

an adjustable chuck for retaining a cartridge;

a cylindrical component comprising an interior surface, an exterior surface, opposed open ends, and at least one opening for receiving the cartridge;

a drive shaft that contacts and rotates the cylindrical component;

a motor in electrical communication with the drive shaft for rotating the cylindrical component about an axis;

a marking device inserted into both of the opposed open ends such that the marking devices contact an exterior surface of the cartridge; and wherein the rotating of the cylindrical component by the motor and the contact of the marking devices create a mark around the circumference of the cartridge.

18. The device of claim 17, wherein there is a plurality of openings comprising different diameters for receiving cartridges of different diameters.

19. The device of claim 17, wherein the marking devices are secured in the cylindrical component via a thumbscrew.

20. The device of claim 17, wherein the motor is in electrical communication with a battery.

* * * * *